United States Patent [19]

Alf et al.

[11] Patent Number: 4,911,660

[45] Date of Patent: Mar. 27, 1990

[54] COAXIAL CABLE ANGLE CONNECTOR

[75] Inventors: Reinhard Alf; Kurt Klinkwitz; Bernd Rustenbach, all of Berlin, Fed. Rep. of Germany

[73] Assignee: Robert Bosch GmbH, Stuttgart, Fed. Rep. of Germany

[21] Appl. No.: 315,212

[22] Filed: Feb. 23, 1989

Related U.S. Application Data

[63] Continuation of Ser. No. 132,728, Dec. 11, 1987, abandoned, which is a continuation of Ser. No. 922,068, Oct. 20, 1986, abandoned.

[30] Foreign Application Priority Data

Feb. 15, 1986 [DE] Fed. Rep. of Germany ..... 3604896

[51] Int. Cl.[4] ..... H01R 17/18

[52] U.S. Cl. ..... 439/585; 439/582; 439/736; 439/881

[58] Field of Search ..... 439/578–585, 439/675, 877–882, 322, 466, 468, 473, 694, 749, 855, 736, 607–610

[56] References Cited

U.S. PATENT DOCUMENTS

| | | | |
|---|---|---|---|
| 4,010,538 | 3/1977 | O'Keefe et al. | 339/177 E |
| 4,269,469 | 5/1981 | Audic | 339/177 R |
| 4,515,427 | 5/1985 | Smit | 339/218 M |
| 4,557,545 | 12/1985 | Ohtsuki et al. | 339/218 M |
| 4,580,862 | 4/1986 | Johnson | 439/585 |
| 4,655,534 | 4/1987 | Stursa | 439/582 |

FOREIGN PATENT DOCUMENTS

| | | | |
|---|---|---|---|
| 0111162 | 6/1984 | European Pat. Off. | 339/143 R |
| 2534111 | 2/1977 | Fed. Rep. of Germany | 339/177 R |
| 2937087 | 7/1981 | Fed. Rep. of Germany . | |

*Primary Examiner*—David Pirlot

*Attorney, Agent, or Firm*—Frishauf, Holtz, Goodman & Woodward

[57] ABSTRACT

To provide for rapid manufacture and ease of assembly, the coaxial connector is formed by an inner center terminal element having a central prong and two clamping elements projecting radially therefrom, the one closest to the prong being clamped over the center conductor (16) of the connecting cable and a further one being clamped or crimped over the insulating jacket of the coaxial cable to be connected, to provide for strain relief. The outer terminal element (25) is a cup-shaped structure which is also formed with a clamping extension (24) projecting radially from the bottom of the wall of the clamping projection and crimped over the outer or sleeve conductor of the coaxial cable (15); the entire assembly is surrounded by injection molding compound which also maintains separation of the clamping extension (24) and the connecting strap (23) with respect to the clamping extensions (13, 14) of the inner conductor.

5 Claims, 3 Drawing Sheets

COAXIAL CABLE ANGLE CONNECTOR

This application is a continuation of application Ser. No. 07/132,728, filed Dec. 11, 1987 now abandoned which is a continuation of 06/922,068 filed Oct. 20, 1986 now abandoned.

The present invention relates to an angle connector for a coaxial cable, and more particularly to a coaxial cable-angle connector combination which is easily made, while providing for excellent electrical connection.

BACKGROUND

A coaxial angle connector has been proposed, see German Pat. No. 29 37 087, in which a metallically conductive housing is connected to the outer or sleeve conductor of a coaxial cable. An inner or central conductor connector is located within the housing, insulated from the housing. The housing itself of the coaxial connector is not insulated against the outside. The particular structure does not provide for strain relief of the coaxial connector with respect to the cable to which it is connected, and causes difficulty when automatic manufacture of the connector and coupling to a coaxial cable is desired.

THE INVENTION

It is an object to provide a coaxial angle connector particularly adapted for combination with a coaxial cable, which is completely insulated, has an internal strain relief, and is simple to manufacture, preferably on automatic machinery.

Briefly, a unitary metallic center terminal element is formed with a cylindrical prong adapted to engage the center terminal of a connecting cable, and with two clamping elements which project radially from the cylindrical prong, preferably from a single metallic flap. The clamping element closest to the cylindrical prong is clamped on a center conductor of the cable of the combination, and the clamping element farther removed is clamped on the insulating jacket of the cable to provide for strain relief. Preferably, the respective clamping elements are crimped over the center conductor and the jacket, respectively. An essentially cup-shaped outer terminal element, as a unitary metallic structure, has a cup-shaped portion and a radially extending clamping extension projecting from the bottom of the cup-shaped portion, the clamping extension spanning over the clamping elements of the center terminal element, with clearance, and being clamped to, for example by crimping, the outer or sleeve conductor of the cable. The entire assembly is encased in a plastic injection molding compound, surrounding the end portion of the coaxial cable and embedding the bottom of the cup-shaped portion and the extension portion of the outer terminal element, also embedding the first and second clamping elements of the center terminal.

The first and second clamping elements of the center terminal and the extension portion of the outer terminal are preferably formed as generally U-shaped portions which, upon assembly, are crimped, respectively, over the center conductor, the insulating jacket, and the outer conductor of the cable, the insulating molding compound surrounding all the crimped portions.

In accordance with a preferred feature of the invention, the cylindrical prong is a hollow cylindrical sheet-metal element, which is unitary with the first and second clamping elements. This results in particularly inexpensive and rapid manufacture, and, in one single working step, the angle connector can be connected to the inner conductor of the coaxial cable as well as to the insulating jacket by merely slipping the respective U-shaped portions over the cable and the jacket and then crimping the U-shaped portions in position. Likewise, the outer terminal element is a unitary sheet-metal structure.

DRAWINGS

DETAILED DESCRIPTION

Figure 1:
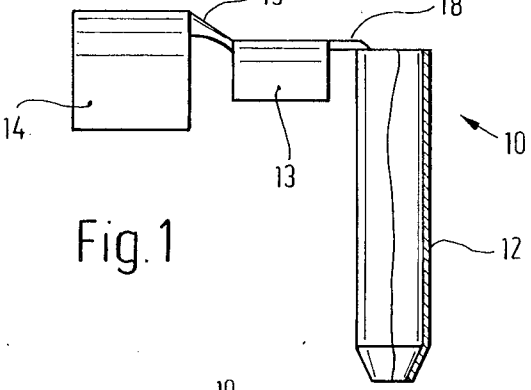
FIG. 1 is a side view of the inner or center terminal element.
Figure 2:
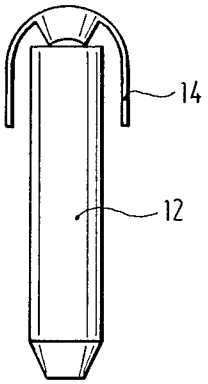
FIG. 2 is an end view of the element of FIG. 1.
Figure 3:
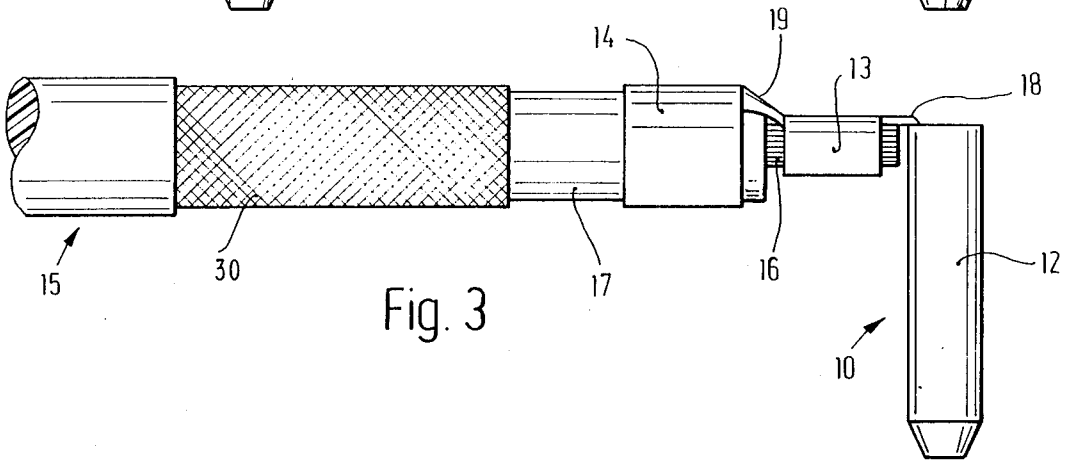
FIG. 3 is a side view of the center terminal element coupled to a cable.
Figures 4, 4A, 5:
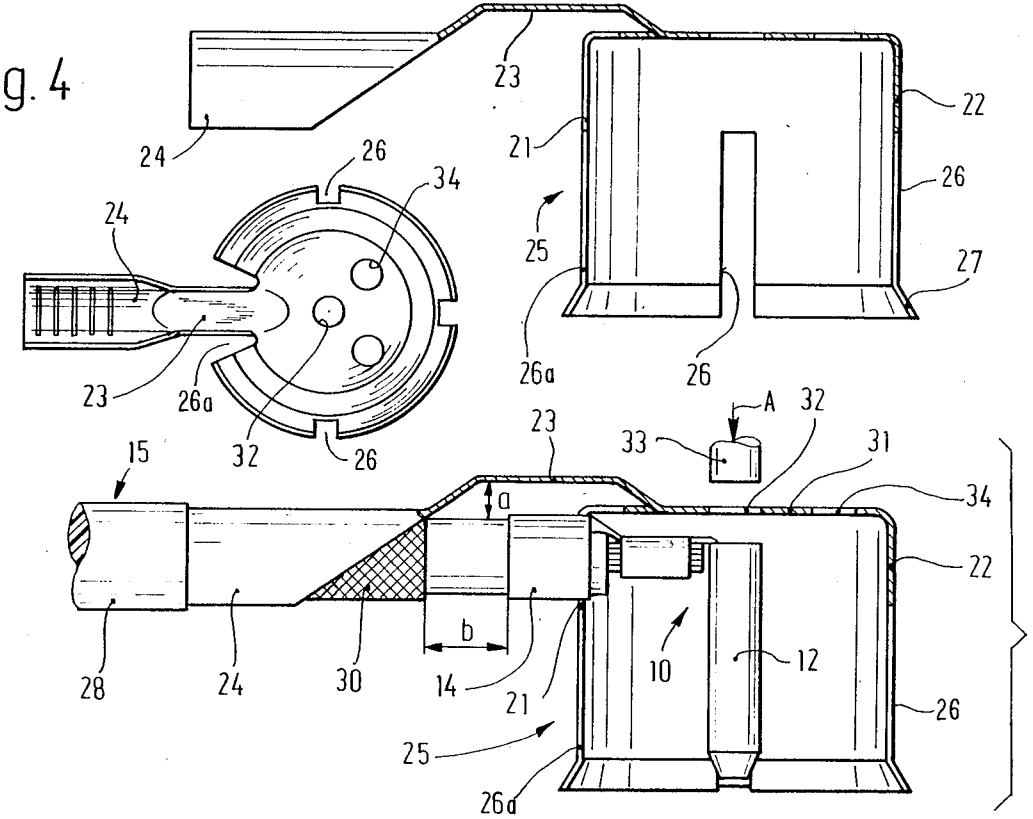
FIG. 4 is a side view of the outer terminal element.
FIG. 4A is a bottom end view of the structure of FIG. 4, to a reduced scale.
FIG. 5 is a part-sectional view illustrating the assembled angle connector on a cable.
Figure 6:
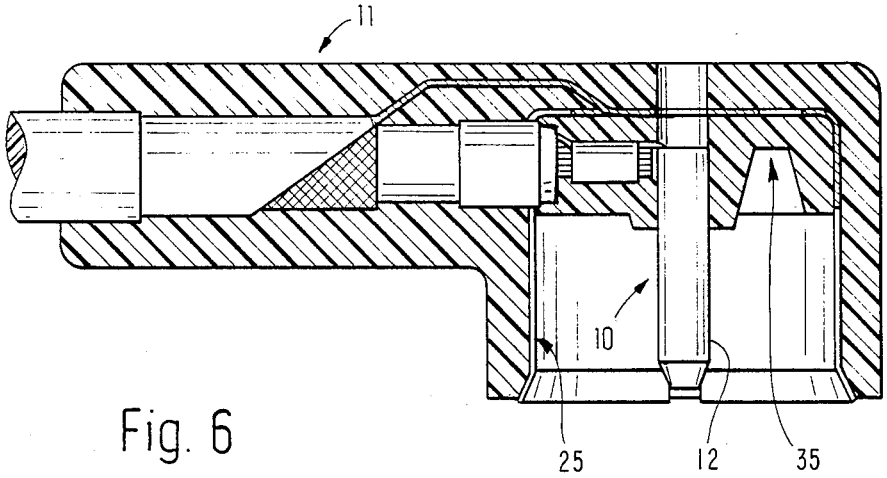
FIG. 6 is a sectional view of the finished angle connector surrounded by an injection molding compound, and connected to a cable.

Referring first to FIG. 6:

The coaxial angle connector 11 is formed with an inner or center terminal element 10 and an outer cup-shaped terminal element 25. As best seen in FIGS. 1–3, the inner terminal element 10 has a cylindrical prong 12 which, preferably, is a hollow cylindrical sheet-metal element which has a unitary extension, extending radially from prong 12. The extension defines two clamping elements 13, 14, each of which is, in cross section, essentially U-shaped. They are connected to the prong 12. As best seen in FIG. 4, the U-shaped form of the clamping element can be easily slipped on the end of a cable 15 (see FIG. 3). The first clamping element 13 surrounds the inner conductor 16 of the cable 15. The second clamping element 14 is slipped over the insulating jacket 17 of the coaxial cable 15. The clamping elements 13, 14 are then crimped, so as to form a good tight electrical contact between the inner conductor 16 and the first clamping element 13, thereby providing excellent electrical connection between the inner conductor 16 and the prong 12 via the clamping portion 13 which is connected by a 18 strap 18 with the prong 12. Upon crimping of the second clamping element 14 about the insulating jacket 17, strain relief for the inner terminal connection between the clamping element 13 and the inner conductor 16 is provided, which is enhanced by injection molding an injection compound around the assembly, as will appear. The bridge or strap 18 forms the connection between the prong 12 and the first clamping element 13 and a second bridge or strap 19 forms a further connection between the first clamping element 13 and the second clamping element 14. Prong 12, bridges or straps 18, 19 and the clamping elements 13, 14 preferably all are made of a single piece of sheet metal.

The outer terminal elements 25 is a cup-shaped circumferentially continuous metallic structure which is slipped over the inner terminal element 10 after it has been assembled to the cable. The cup-shaped structure 25 has a cylindrical portion 22, and a bottom wall 31 which is integral with a third campling element 24, having, at least at its outer end, an essentially U-shaped cross section. The cylindrical portion 22, a connecting bridge or strap 23, and the third clamping portion or extension 24 form, together, the unitary sheet-metal outer terminal element 25 for the coaxial connector. The cylindrical portion 22 is formed with a plurality of axial slits 26 extending through the end of the cylindrical portion 22 (see FIG. 4) to permit resilient engagement of the outer terminal element 25 with a sleeve conductor 30 (FIGS. 3, 5) of the cable. The free end of the cylindrical portion is formed with a conical enlargement 27 to facilitate connection with another cable. The axial slit 26*a* can be wider than the slits 26, and can be formed as a bent-out portion from the side walls of the cylindrical portion 22, leaving an upper opening 21 for insertion of the center element and the cable connection thereto.

ASSEMBLY

First, the center terminal element 10 is connected to the cable 15. Then, the center terminal element 10 is introduced through the opening 21 into the cylindrical portion 22 until the clamping extension 24 is in position to surround the outer or jacket or sleeve conductor 30 of the coaxial cable 15. The third clamping portion or extension 24 is then crimped to form a secure electrical terminal between the outer conductor 30 and the outer terminal element 25.

It is important that the thus pre-assembled angle connector will retain its aligned position with the cup axis at right angle to the cable 15 during injection molding. In order to insure such positional relationship, and the coaxial position of the prong 12 within the cup-shaped element 22, the bottom 31 of the cup-shaped element 22 is formed with a central opening 32 through which a guide element 33, forming a guide tool, can be introduced in the direction of the arrow A. To prevent any possible short circuit between the inner terminal element 10 and the outer terminal element 25, the bridge or connector 23 is spaced from the cable 15 by a distance a (FIG. 5). The outer or sleeve conductor 30 of the cable is somewhat foreshortened, to maintain a sufficient insulating gap b between the second clamping element 14 of the inner conductor 10 and the outer jacket conductor 30 of the cable. Preferably, the bottom 31 of the cup-shaped element 22 is formed with additional penetration openings 34 to permit injection molding compound to pass through the bottom wall 31 of the cup-shaped structure 25 and securely retain it in position during injection molding. The finished article is best seen in FIG. 6. As shown, the entire assembly is surrounded by injection molding compound, down to the rim, and the molding die can be shaped to provide a part-circular recess 35 (FIG. 6) to reduce the weight of the element and to decrease the quantity of injection molding compound which is needed.

A suitable plastic injection molding material is polyethylene or polypropylene; these are preferred substances. The central terminal element 10 as well as the metallic outer terminal element 25 preferably are made of springy material, such as spring-hardened bronze sheet metal, or German silver, such as Argentan. The surrounding molding material provides resilient mechanical support to the portions of the cup-shaped structure 25 located between the slits 26. If necessary, the metallic elements can be galvanically surface-treated in order to provide corrosion protection and improve extremely low resistance terminal connection characteristics.

Various changes and modifications may be made within the scope of the inventive concept.

We claim:

1. A fast-assembling internally strain-relieved angle connector (11) in combination with a coaxial cable (15), in which the coaxial cable has a center conductor (16);

an insulating jacket (17) surrounding the center conductor; and wherein the angle connector (11) comprises a unitary metallic center terminal element (10) including a cylindrical prong (12) which is formed as a cylindrical sheet-metal element;

two generally U-shaped clamping elements (13, 14);

a first strap or bridge portion (18) angled off radially at essentially a right angle from said prong (12) and connecting the prong (12) and a first one of the clamping elements (13), and a second strap or bridge portion (19) connecting the first one of the clamping elements and a second one (14) of the clamping elements, the first one (13) of the clamping elements being clamped on the center conductor (16) of the coaxial cable and the second one (14) of the clamping elements being clamped on the insulating jacket (17) of the coaxial cable to provide a strain relief;

a single unitary metallic outer sheet-metal cup-shaped terminal element (25) including a unitary, circumferentially continuous, essentially cylindrical portion (22) defining a cup axis, a bottom wall portion (31), a clamping portion (24) projecting radially from the bottom wall portion (31), and a bridge or connecting strap portion (23) connecting the clamping portion (24) and the bottom wall portion (31);

wherein said bridge or connecting strap portion (23) spans over said two clamping elements (13, 14) and the respective first and second bridge or strap portions (18, 19) connecting said two clamping elements to the prong (12) with a separating clearance;

said cup axis extends at right angle to said coaxial cable;

wherein penetration openings (34) are formed in said bottom wall portion (31);

said cylindrical portion (22) is formed with an insertion opening (21) dimensioned to receive at least one of the clamping elements (13, 14) and at least one of said at least first and second bridge or strap portions (18, 19) of the center terminal element (10); and wherein a plastic injection molding compound is provided, surrounding the end portion of the coaxial cable (15) and the entire outer surface of the outer terminal element (25), and further embedding said first and second clamping elements (13, 14) and said first and second strap or bridge portions (18, 19), said injection molding compound being further injected in the space defined by said separating clearance to maintain the electrical separation of the outer terminal element (25) and the center terminal element (10) and penetrating through the penetration openings (34) in the inside of said cup-shaped outer terminal element and adjacent the wall portion (31) thereof;

wherein the cylindrical portion (22) of the metallic outer terminal (25) is formed with axial slits extending through the outer edge of said cylindrical portion, leaving regions of said cylindrical portion between said axial slits, and the terminal regions of said portions between said axial slits are formed with a conical enlargement (27) at the free end thereof, said slits extending through said free ends;

and wherein said injection molding compound surrounding the outer terminal element extends to said edge and over said enlargement (27) and provides resilient mechanical support to the regions of the outer terminal element between said axial slits.

2. A fast-assembling, internally strain-relieved angle connector (11) in combination with a coaxial cable (15), in which the coaxial cable has a center conductor (16);

an insulating jacket (17) surrounding the center conductor;

an outer sleeve conductor (30); and wherein the angle connector (11) comprises a unitary metallic center terminal element (10) including a cylindrical prong (12) which is formed as a cylindrical sheet-metal element;

two generally U-shaped clamping elements (13, 14), each having projecting legs and a connecting portion, said legs extending essentially parallel to said prongs;

a first bridge or strap portion (18) angled off radially at essentially a right angle from said prong (12) and connecting the prong (12) and the connecting portion of a first one of the clamping elements (13), located adjacent said prong, and a second bridge or strap portion (19) connecting the connecting portion of the first one of the clamping elements and the connecting portion of a second one (14) of the clamping elements;

the legs of the first one (13) of the clamping elements being clamped on the center conductor (16) of the coaxial cable and the legs of the second one (14) of the clamping elements being clamped on the insulating jacket (17) of the coaxial cable to provide a strain relief;

a single unitary metallic outer sheet-metal cup-shaped terminal element (25) including a unitary, circumferentially continuous, essentially cylindrical portion (22) defining a cup axis, a bottom wall portion (31), a cup clamping portion (24) projecting radially from the bottom wall portion (31), having clamping legs, and a cup bridge or connecting strap portion (23) connecting the cup clamping portion (24) and the bottom wall portion (31);

wherein said cup bridge or connecting strap portion (23) spans over the connecting portion of said two clamping elements (13, 14) and over both the first and second bridge or strap portions (18, 19) connecting said two clamping elements to the prong (12) with a separating clearance and is clamped on the outer sleeve conductor (30);

said cup axis extends at right angle to said coaxial cable and at essentially a right angle with respect to said cup bridge or connecting strap portion;

wherein penetration openings (34) are formed in said bottom wall portion (31);

said cylindrical portion (22) is formed with an insertion opening (21) dimensioned to receive at least one of the clamping elements (13, 14) and at least one of said at least first and second bridge or strap portions (18, 19) of the center terminal element (10); and wherein a plastic injection molding compound is provided, surrounding the end portion of the coaxial cable (15) and the entire outer surface of the outer terminal element (25), and further embedding said first and second clamping elements (13, 14) and said first and second strap or bridge portions (18, 19), and said injection molding compound being further injected in the space defined by said separating clearance to maintain the electrical separation of the outer terminal element (25) and the center terminal element (10) and penetrating through the penetration openings (34) in the inside of said cup-shaped outer terminal element and adjacent the wall portion (31) thereof.

3. The combination of claim 2, wherein said cylindrical portion (22) is formed with a conical enlargement (27) at a free end thereof.

4. A fast-assembling, internally strain-relieved angle connector (11) in combination with a coaxial cable (15), in which the coaxial cable has a center conductor (16);

an insulating jacket (17) surrounding the center conductor;

an outer sleeve conductor (30); and wherein the angle connector (11) comprises a unitary metallic center terminal element (10) including a cylindrical prong (12) which is formed as a cylindrical sheet-metal element;

two generally U-shaped clamping elements (13, 14), each having projecting legs and a connecting portion, said legs extending essentially parallel to said prongs;

a first bridge or strap portion (18) angled off radially at essentially a right angle from said prong (12) and connecting the prong (12) and the connecting portion of a first one of the clamping elements (13), located adjacent said prong, and a second bridge or strap portion (19) connecting the connecting portion of the first one of the clamping elements and the connecting portion of a second one (14) of the clamping elements;

the legs of the first one (13) of the clamping elements being clamped on the center conductor (16) of the coaxial cable and the legs of the second one (14) of the clamping elements being clamped on the insulating jacket (17) of the coaxial cable to provide a strain relief;

a single unitary metallic outer sheet-metal cup-shaped terminal element (25) including a unitary, circumferentially continuous, essentially cylindrical portion (22) defining a cup axis, a bottom wall portion (31), a cup clamping portion (24) projecting radially from the bottom wall portion (31), having clamping legs, and a cup bridge or connecting strap portion (23) connecting the cup clamping portion (24) and the bottom wall portion (31);

wherein said cup bridge or connecting strap portion (23) spans over the connecting portion of said two clamping elements (13, 14) and over both the first and second bridge or strap portions (18, 19) connecting said two clamping elements to the prong (12) with a separating clearance and is clamped on the outer sleeve conductor (30);

said cup axis extends at right angle to said coaxial cable and at essentially a right angle with respect to said cup bridge or connecting strap portion;

wherein penetration openings (34) are formed in said bottom wall portion (31);

said cylindrical portion (22) is formed with an insertion opening (21) dimensioned to receive at least one of the clamping elements (13, 14) and at least one of said at least first and second bridge or strap portions (18, 19) of the center terminal element (10); and wherein a plastic injection molding compound is provided, surrounding the end portion of the coaxial cable (15) and the entire outer surface of the outer terminal element (25), and further embedding said first and second clamping elements (13, 14) and said first and second strap or bridge portions (18, 19), said injection molding compound being further injected in the space defined by said separating clearance to maintain the electrical separation of the outer terminal element (25) and the center terminal element (10) and penetrating through the penetration openings (34) in the inside of said cup-shaped outer terminal element and adjacent the wall portion (31) thereof; and wherein the cylindrical portion (22) of the metallic outer terminal element (25) is formed with axial slits, said injection molding compound surrounding the outer terminal element (25) and providing resilient mechanical support to said outer terminal element in the region between the axial slits thereof.

5. The combination of claim 4, wherein said cylindrical portion (22) is formed with a conical enlargement (27) at the free end thereof.

* * * * *